US007093726B1

(12) United States Patent
Holztrager

(10) Patent No.: US 7,093,726 B1
(45) Date of Patent: Aug. 22, 2006

(54) CURVED DISPLAY SHELF

(75) Inventor: William H. Holztrager, Bristol, TN (US)

(73) Assignee: Showall, Inc., Chilhowie, VA (US)

( * ) Notice: Subject to any disclaimer, the term of this patent is extended or adjusted under 35 U.S.C. 154(b) by 33 days.

(21) Appl. No.: 10/695,797

(22) Filed: Oct. 30, 2003

(51) Int. Cl.
*A47F 5/08* (2006.01)

(52) U.S. Cl. ..... 211/90.01; 211/94.01; 211/153

(58) Field of Classification Search ..... 211/90.01, 211/94.01, 86.01, 207, 187, 87.01, 133.3, 211/88.01, 126.5, 153, 126.16; D6/553, D6/567, 573, 574; 108/108, 25; 312/245, 312/138.1

See application file for complete search history.

(56) References Cited

U.S. PATENT DOCUMENTS 2,911,108 A * 11/1959 Nield ..... 108/152
3,414,133 A * 12/1968 Guerri et al. ..... 211/107
3,984,004 A * 10/1976 Devanney ..... 211/133.1
4,531,331 A 7/1985 Itagaki
4,598,504 A 7/1986 Itagaki
D287,203 S * 12/1986 Jenkins et al. ..... D6/573
4,649,012 A 3/1987 Witte
4,718,561 A * 1/1988 Eckert ..... 211/85.1
4,749,535 A 6/1988 Matsuda
4,752,010 A 6/1988 Holztrager
4,786,456 A 11/1988 Witte
4,886,236 A * 12/1989 Randall ..... 248/250
5,025,931 A 6/1991 Berger
5,044,285 A * 9/1991 Wolfe, III ..... 108/152
5,101,986 A 4/1992 Holztrager
D328,538 S 8/1992 Berger
D350,245 S 9/1994 Branz et al.
D352,198 S * 11/1994 Wright et al. ..... D6/574
5,390,462 A 2/1995 Kreiter
5,424,023 A 6/1995 Riley et al.
5,485,934 A 1/1996 Holztrager
D369,924 S 5/1996 Werner et al.
5,653,348 A 8/1997 MacDonald
5,921,044 A 7/1999 Holztrager
5,983,574 A 11/1999 Holztrager
D418,341 S * 1/2000 Carville et al. ..... D6/509
6,087,635 A 7/2000 Reinbold et al.
6,142,140 A * 11/2000 Shumaker ..... 126/9 B
6,267,461 B1 * 7/2001 Dunagan et al. ..... 312/49
6,474,327 B1 * 11/2002 Bossler ..... 126/41 R
D468,146 S * 1/2003 Hoernig ..... D6/574
D471,993 S 3/2003 Holztrager
6,837,386 B1 * 1/2005 Kent et al. ..... 211/153

* cited by examiner

*Primary Examiner*—Jennifer E. Novosad
(74) *Attorney, Agent, or Firm*—Shlesinger, Arkwright & Garvey LLP

(57) ABSTRACT

A curved display shelf comprises an arcuate sidewall having an upper edge, the sidewall including at least one groove from which to hang merchandise; a top panel secured to the upper edge; and at least one hook operatively secured to the slatwall member for hanging to a display wall.

11 Claims, 4 Drawing Sheets

FIG. 4
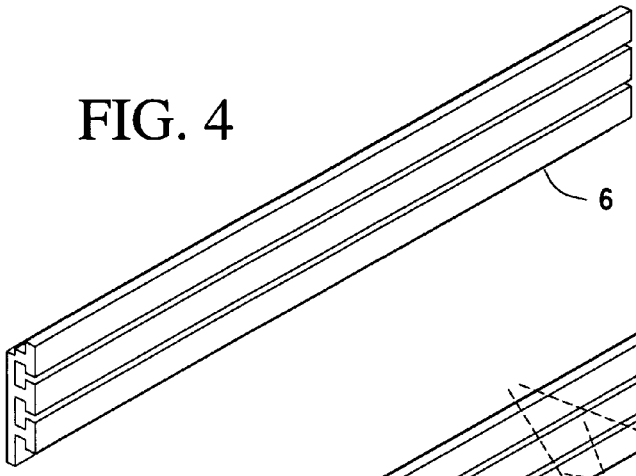
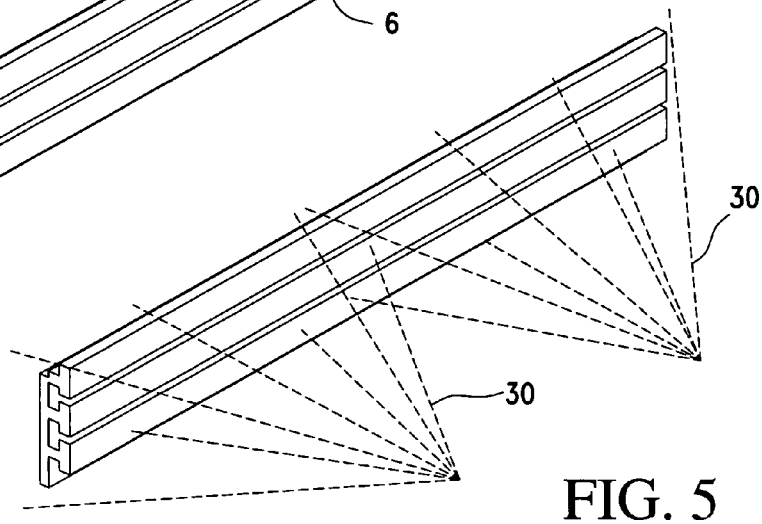
FIG. 5
FIG. 6
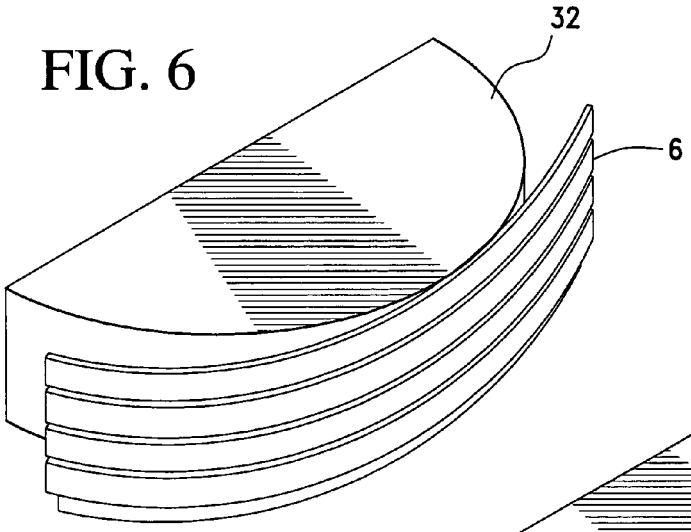
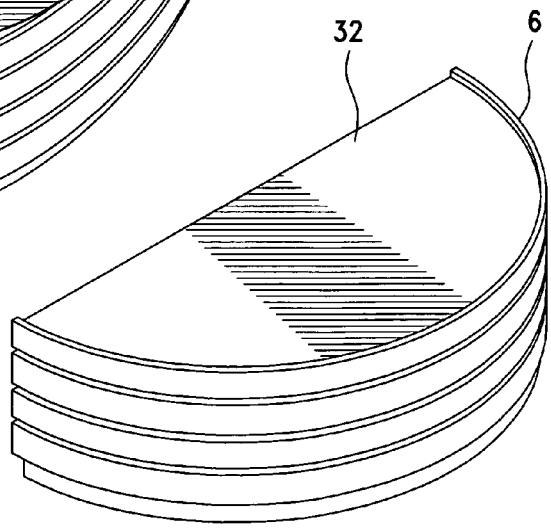
FIG. 7

CURVED DISPLAY SHELF

FIELD OF THE INVENTION

The present invention relates generally to a merchandise display apparatus and particularly to a curved display shelf that can be hung from a slatwall to provide additional display space for merchandise.

BACKGROUND OF THE INVENTION

A slatwall is generally used for displaying merchandise. The grooves provided by the slatwall are used to hang standard hardware, which may be used to support a shelf on which to display merchandise. However, the space immediately beneath the shelf may become unusable for hanging additional merchandise, since it is obscured by the shelf. There is, therefore, a need for providing a shelf that provides visible hanging space underneath for displaying additional merchandise.

OBJECTS AND SUMMARY OF THE INVENTION

It is an object of the present invention to provide a curved display shelf that can be hung from a wall to provide additional display space for merchandise.

It is another object of the present invention to provide a curved display shelf having a side wall made from slatwall member from which merchandise may be hung using standard hardware.

In summary, the present invention provides a curved display shelf, comprising an arcuate sidewall having an upper edge, the sidewall including at least one groove from which to hang merchandise; a top panel secured to the upper edge; and at least one hook operatively secured to the slatwall member for hanging to a display wall.

These and other objects of the present invention will become apparent from the following detailed description.

BRIEF DESCRIPTIONS OF THE DRAWINGS

FIGS. 4–8 are perspective views of a process for making the curved display shelf of FIG. 1.

DETAILED DESCRIPTION OF THE INVENTION

Figure 1:
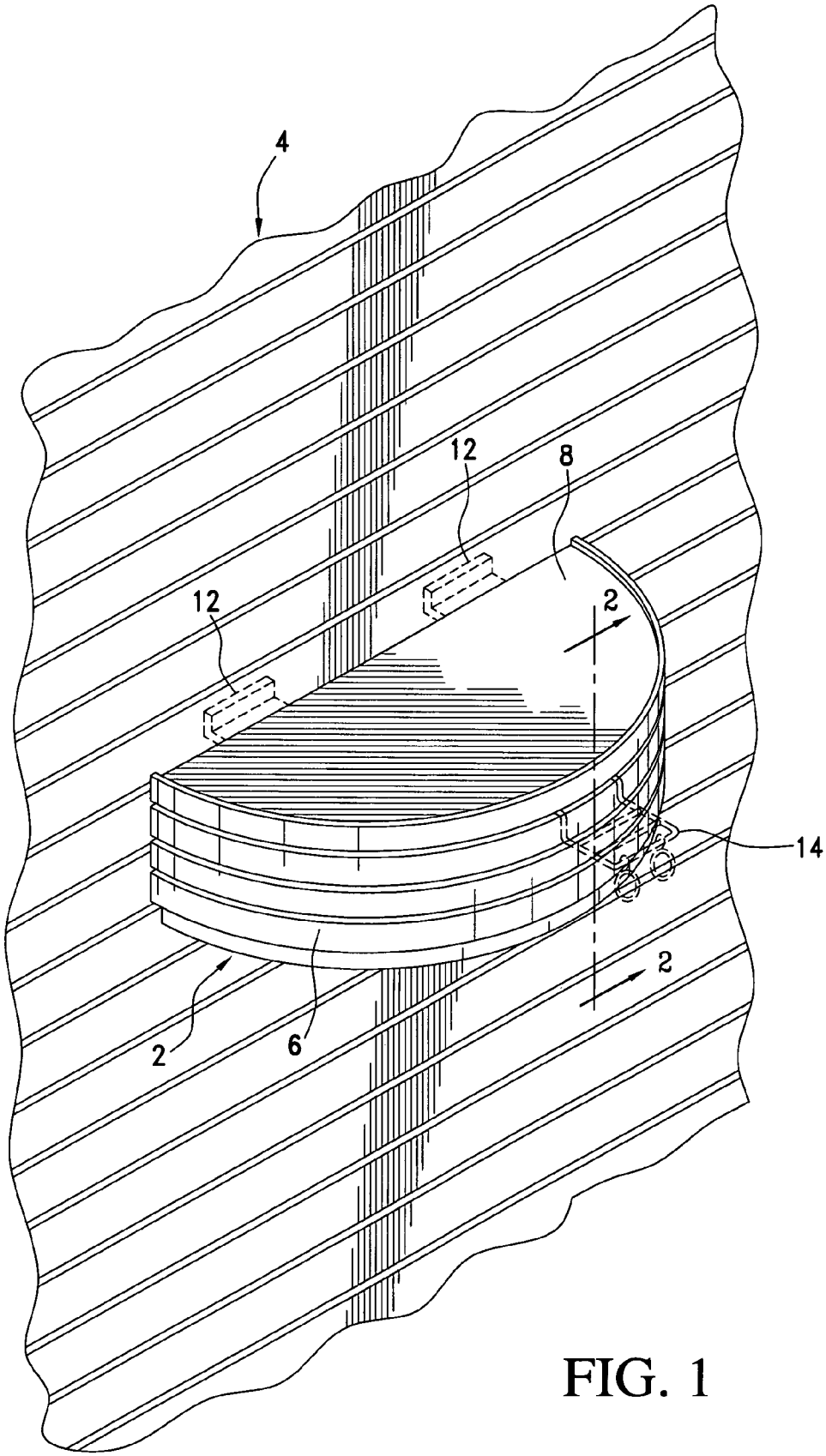
FIG. 1 is a top perspective view of a curved display shelf made in accordance with the present invention.
Figure 2:
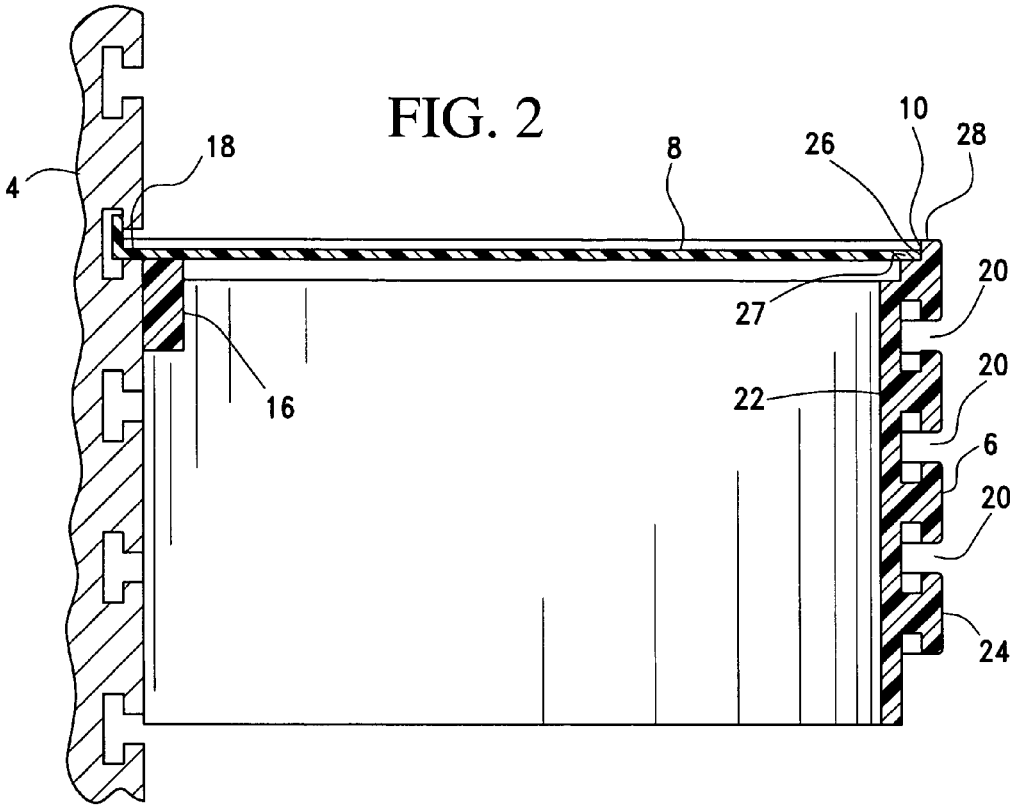
FIG. 2 is cross-sectional view taken along line 2—2 of FIG. 1.
Figure 3:
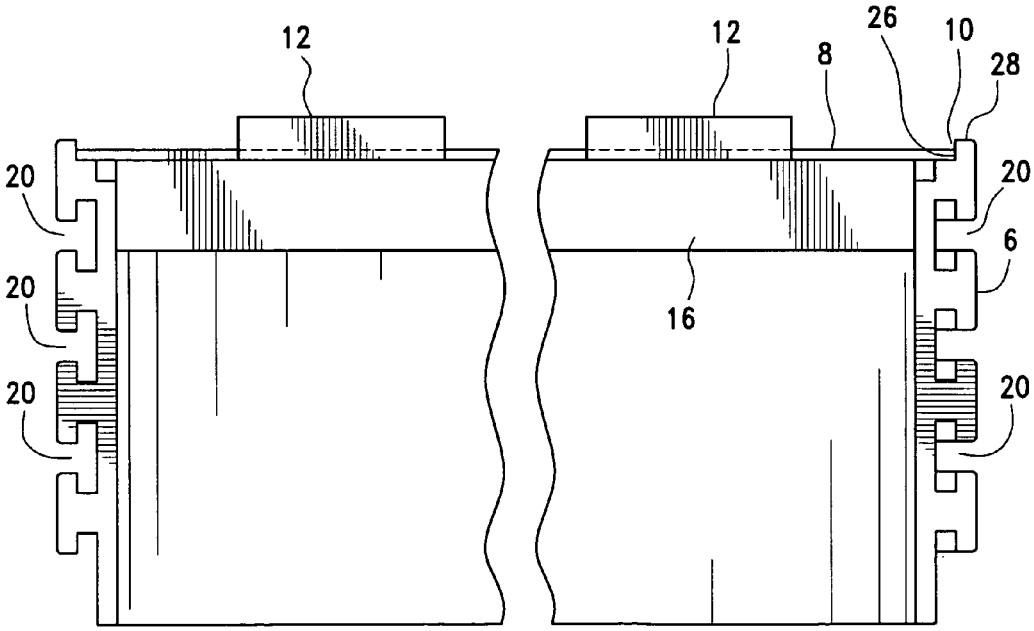
FIG. 3 is a back end view of the curved display shelf of FIG. 1.

A display shelf 2 made in accordance with the present invention is disclosed in FIG. 1. The display shelf 2 is shown hanging from a slatwall 4. However, the display shelf 2 may also be hung from a grid wall or recessed standards. The display shelf 2 has an arcuate side wall 6 made from a slatwall member, preferably of extruded polyvinylchloride plastic material. A top panel 8 is secured along an upper outer edge 10 of the sidewall 6, as shown in FIGS. 2 and 3, and preferably conforms to the overall shape of the sidewall 6 as viewed from the top. A pair of hooks 12 are operably secured to the top panel 8 to provide means for hanging the display shelf 2 from the slatwall 4. Although two hooks 12 are shown, it should be understood that one may be sufficient, depending on the type of hook used, since it should be understood that the display shelf 2 may fitted with various types of hanging hardware to allow it be hung from all types of slotted wall and fixture systems, in addition to others, such as recessed standards, grid wall, puck systems or any systems that require attachment or hanging hardware.

The top panel 8 advantageously provides a flat surface on which to display merchandise. The sidewall 6 is advantageously configured to utilize standard slatwall hardware, such as hanger 14, to allow additional merchandise to be displayed on the slatwall 4. The sidewall 6 advantageously extends away from the slatwall 4, affording merchandise hanging therefrom a more visible location. The curved display shelf 2 advantageously provides the user with a softer look on an otherwise flat slatwall.

A reinforcing member 16 secured along the back edge 18 of the panel 8 to provide additional support to the panel 8 and reinforcement to the hooks 12. The sidewall 6 has a plurality of horizontal, spaced apart grooves 20, preferably T-shaped, although other groove configurations may be used, such as those disclosed in U.S. Pat. Nos. 5,485,934, D471,993 or 4,752,010, hereby incorporated by reference. The grooves 20 are configured to accept standard hanging hardwares, such as item 14 shown in FIG. 1. The sidewall 6 has a base wall 22 and a plurality of T-shaped ribs 24 arranged horizontally and parallel to each other to form the grooves 20. The sidewall 6 may be extruded in one piece or built up from individual extruded pieces. Although the sidewall 6 is shown with a plurality of grooves 20, it should be understood that a sidewall 6 with one groove 20 is also envisioned. The upper edge 10 of the sidewall 2 preferably includes a recess 26 adapted to receive the peripheral outer edge 27 of the top panel 8, as shown in FIGS. 2 and 3. The top panel peripheral edge 27 may also extend beyond the outer edge 10. However, it is preferable to attach the top panel 8 to the side wall 6 such that an upper lip 28 is created to provide a stop for any object placed on the panel 8 from sliding off the panel.

Figure 8:
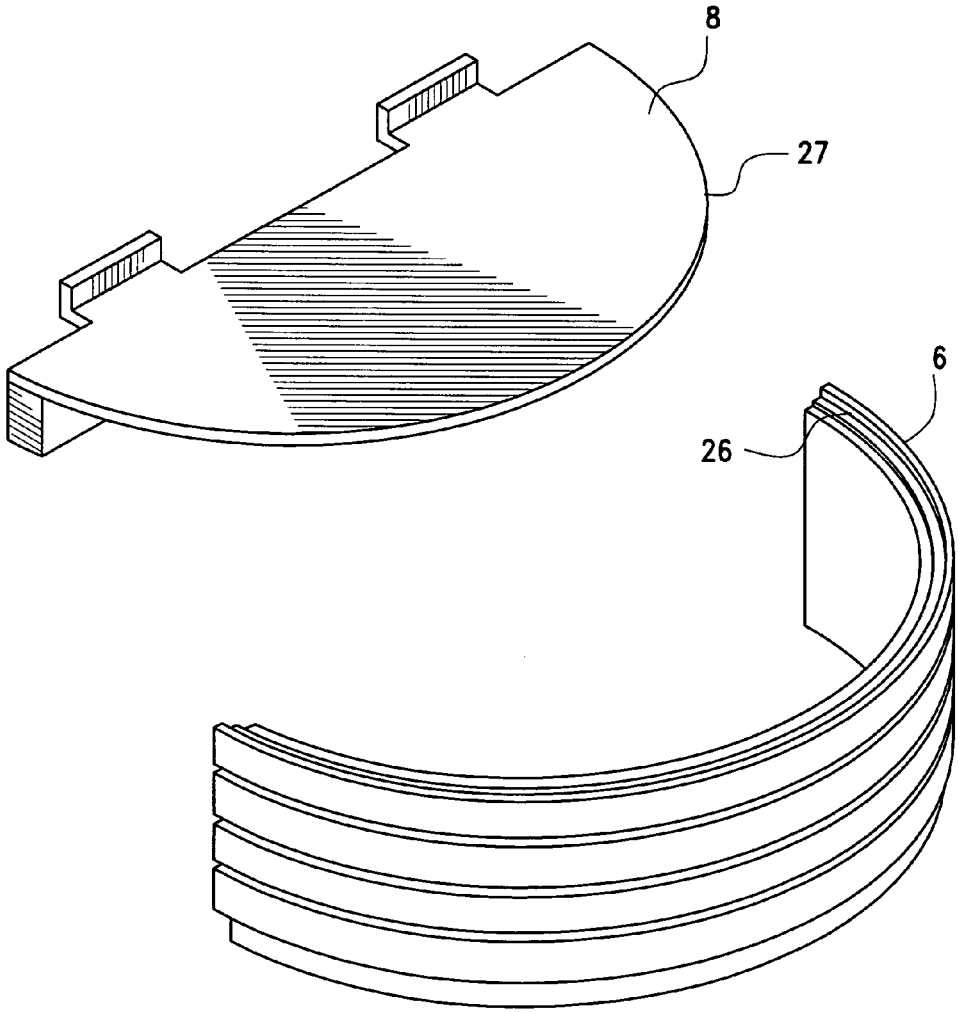

Referring to FIGS. 4–7, the sidewall 6 is initially a straight slatwall member which is subjected to heat energy, generally represented by the phantom lines 30, to bring its temperature to about 320° F. Preferably, the slatwall member is placed in an oven at about 320° F. for about 3–10 minutes, depending on its thickness and size. The softened slatwall member is then pressed against a mold 32 and held against it until it cools down. The slatwall member then retains the shape of the mold. The top panel 8 is then secured to the recess 28 of the sidewall 6, as shown in FIG. 8. It becomes very pliable and is immediately bent around the form 32 and held for about 2–3 minutes allowing slatwall member to cool, after which the slatwall member stays bent to the shape of the form. The sidewall 6 may be bent to any arcuate shape and arc as desired, such as semi-circular, 180° arc as shown in FIG. 1.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A curved display shelf, comprising:

a) an arcuate sidewall having an upper edge, said sidewall is a slatwall member having at least one groove from which to hang merchandise;

b) a top panel secured to said upper edge; and c) at least one hook operatively secured to said slatwall member for hanging to a vertical display wall.

2. A curved display shelf as in claim 1, wherein said sidewall is a slatwall member.

3. A curved display shelf as in claim 1, wherein said slatwall member is bent to a semi-circular shape.

4. A curved display shelf as in claim 1, wherein said slatwall member has a plurality of horizontally parallel grooves.

5. A curved display shelf as in claim 4, wherein said grooves are T-shaped in cross-section.

6. A curved display shelf as in claim 1, wherein:

a) said upper edge has a recess; and b) said panel has a peripheral edge disposed in said recess.

7. A curved display shelf as in claim 1, wherein said upper edge extends above a top surface of said top panel.

8. A curved display shelf as in claim 1, wherein slatwall member is a single piece made of extruded plastic.

9. A curved display shelf as in claim 1, wherein said at least one hook is configured to be hung from a slatwall.

10. A curved display shelf as in claim 1, wherein said at least one hook is attached to said top panel.

11. A curved display shelf as in claim 1, and further comprising a member secured along a back edge of said top panel.

* * * * *